US006134519A

United States Patent [19]

Aihara

[11] Patent Number: 6,134,519

[45] Date of Patent: Oct. 17, 2000

[54] VOICE ENCODER FOR GENERATING NATURAL BACKGROUND NOISE

[75] Inventor: Satoshi Aihara, Tokyo, Japan

[73] Assignee: NEC Corporation, Tokyo, Japan

[21] Appl. No.: 09/093,258

[22] Filed: Jun. 8, 1998

[30] Foreign Application Priority Data

Jun. 6, 1997 [JP] Japan ..... 9-149551

[51] Int. Cl.[7] ..... G10L 11/00

[52] U.S. Cl. ..... 704/208; 704/210; 704/214; 704/207

[58] Field of Search ..... 704/208, 207, 704/214, 219, 223, 262, 210

[56] References Cited

U.S. PATENT DOCUMENTS 5,890,108 3/1999 Yeldener ..... 704/208

6,029,134 2/2000 Nishigushi et al. ..... 704/268

*Primary Examiner*—Richemond Dorvil

*Assistant Examiner*—Susan Wieland

*Attorney, Agent, or Firm*—Ostrolenk, Faber, Gerb & Soffen, LLP

[57] ABSTRACT

A voice encoder using a VOX (voice operated transmission) control has a pitch analyzer and a high-efficiency encoder. When a voiced state is detected in an input audio signal, the input audio signal and pitch information extracted therefrom are encoded by the high-efficiency encoder and transmitted to a voice decoder. When an unvoiced state is detected, the high-efficiency encoder encodes the input audio signal without a gain of the pitch information. The encoded data without using the gain information is transmitted after a post-amble signal to obtain natural background noise.

6 Claims, 4 Drawing Sheets

VOICE ENCODER FOR GENERATING NATURAL BACKGROUND NOISE

BACKGROUND OF THE INVENTION (a) Field of the Invention

The present invention relates to a voice encoder for generating natural background noise and, more particularly, to a voice encoder for use in a digital mobile communication system which performs a VOX Voice Operated Transmission) control. The present invention also relates to a voice encoding method.

(b) Description of the Related Art

In a digital mobile communication system, a VOX control is generally used which stops transmission of encoded signals for reduction of power dissipation when the input audio signal does not include voice in a frame. More specifically, when the communication system enters an unvoiced frame, the transmitting section of the communication system transmits a code series indicating the unvoiced frame instead of the encoded audio signals and the receiving section generates a background noise code series for a certain interval after receiving the signal thus transmitted. Such a communication system is described in, for example, JP-A-5(1993)-122165.

FIG. 1 shows a voice encoder of a conventional mobile communication system, such as mentioned above. The voice encoder comprises a voiced-unvoiced detector 11, a pitch analyzer 12, a high-efficiency encoder 13, a VOX unique word generator 14 and a data selector 15. Referring additionally to FIG. 2 showing a flowchart of the conventional voice encoder of FIG. 1, the operation of the conventional voice encoder of FIG. 1 will be described.

In a digital communication system using the high-efficiency voice encoding/decoding scheme, an input audio signal is divided into a plurality of frames each having a time period of about 40 milliseconds (msec). The input audio signal, divided into the frames, is supplied to the voiced-unvoiced detector 11, wherein it is judged whether or not the input audio signal includes voice for each frame (step B1).

If it is judged that the input audio signal includes voice in the present frame, pitch parameters, which characterize the voice of each frame together with a spectrum parameter, are extracted by the pitch analyzer 12 from the input audio signal (step B2). Pitch parameters or pitch information are described in "Digital Sound Processing" pp. 57–59, by Furui, Sep. 25, 1985, Tokai University Publication Association, for instance. The pitch information from the pitch analyzer 12 is supplied together with the input audio signal to the high-efficiency encoder 13, wherein the high-efficiency voice encoding is performed (step B3) together with extracting other parameters such as spectrum parameter. The data selector 15 selects, based on the information of the voiced state of the frame, the high-efficiency encoded signal as the data for transmission, which is transmitted to the receiving section or decoder (not shown in the figure) of the communication system.

On the other hand, if it is judged by the voiced-unvoiced detector 11 that the input audio signal does not include voice in the present frame whereas the input audio signal included voice in the precedent frame, the VOX unique word generator 14 generates a post-amble signal for the present frame (step B4), which is selected as the data for transmission by the data selector 15 and transmitted to the voice decoder (step B5). The input audio signal of the subsequent frame is encoded by the high-efficiency encoder 13 (step B3), as is the case of the voiced frame, and selected for data for transmission (step B5). The encoded signal for the subsequent frame is used for updating background noise in the decoder and referred to as a background updating code series.

The voice encoder then stops transmission of data for N frames, wherein N is a constant. If the unvoiced state continues for more than N frames, another post-amble signal and another background updating code series are transmitted after N frames elapsed, followed by stopping of transmission for additional N frames.

The voiced-unvoiced detector 11 continues detection of the voiced-unvoiced state of the input audio signal in each frame during the stopping of transmission by the voice encoder. If the voiced-unvoiced detector 11 detects a voiced frame of the input audio signal during the stopping of the transmission, the VOX unique word generator 14 generates a pre-amble signal for the frame, which is transmitted to the decoder through the data selector 15. The high-efficiency encoder 13 encodes the input audio signal from the next frame in the subsequent frames to generate high-efficient code series, which are successively transmitted to the decoder.

In the receiving section, the voice decoder decodes the received code series to regenerate parameters including the pitch parameters mentioned before, based on which it is judged whether or not the input audio signal of the present frame includes voice. If it is judged that the input audio signal of the present frame included voice, the voice decoder decodes the parameters to generate decoded audio signals. On the other hand, if a post-amble signal is received due to the unvoiced frame of the input audio signal, the voice decoder repeatedly generates background noise for N frames based on the parameters included in the background updating code series, the background noise being updated after each N frames based on a new post-amble signal and a new background updating code series.

JP-A-2(1990)-181800 also describes a related technique in a voice encoding/decoding system, wherein the amplitudes and the positions of multi-pulse are calculated by using a pitch predicting multi-pulse method in a voiced frame, whereas only the amplitudes of the multi-pulse are calculated, with the positions being fixed, in an unvoiced frame. It is recited that the technique achieves an excellent tone of the background noise even in the case of a low bit rate transmission.

JP-A-8(1996)-139688 also describes a related technique in a voice encoder for use in a mobile station, wherein output of the encoder is selected for generating background noise when the voiced-unvoiced detector detects an unvoiced frame. This technique is also capable of reducing a sense of incongruity of the voice output from the decoder and caused by the periodic tone variation in the background noise for an unvoiced frame during VOX (or VAD) processing by the mobile station.

JP-A-7(1995)-334197 also describes a related technique in a voice encoding/coding system, wherein background noise is generated in the decoder by interpolation of encoded data received intermittently, thereby preventing a sense of incongruity of decoded output even when the background noise is continuously decoded by the receiving section.

In the conventional voice encoders as mentioned above, the following problems exist in the output background noise in successive unvoiced frames.

The parameters for the input audio signal include pitch parameters or pitch components which features particular voice by representing a periodic vibration of vocal chords among human vocal mechanisms. The pitch clearly appears in voiced sound and does not appear in unvoiced sound. Accordingly, if a background noise is generated with the pitch parameters included in the parameters of the unvoiced frame, the resultant background noise involves an unnatural tone.

SUMMARY OF THE INVENTION

It is therefore an object of the present invention to provide a voice encoder for use in a communication system which is capable of obtaining natural background noise even when unvoiced frames continue in the input audio signal.

It is another object of the present invention to provide a method for encoding an input audio signal to transmit a natural background signal.

The present invention provides, in a first aspect thereof, a voice encoder comprising a voiced-unvoiced detector for judging whether or not an input audio signal includes voice in each frame of the input audio signal to output a voiced-unvoiced signal, a pitch analyzer for extracting pitch information from the input audio signal, a signal selector for selectively outputting a first signal including the input audio signal and the pitch information or a second signal including the input audio signal with a part of the pitch information invalidated depending on the voiced-unvoiced signal, a high-efficiency encoder for encoding the first signal or the second signal to generate first data or second data, and a data selector for selectively transmitting the first data during a voiced state of the input audio signal or transmitting the second data and subsequently stopping transmission when an unvoiced state of the input audio signal is detected subsequent to a voiced state.

The present invention also provides, in a second aspect thereof, a method for encoding an input audio signal comprising the steps of judging voiced or unvoiced state of an input audio signal in each frame for the input audio signal, generating first data encoded from the input audio signal and pitch information of the input audio signal or second data encoded from the input audio signal with a part of the pitch information invalidated depending on voiced or unvoiced state of the input audio signal, transmitting the first data during a voiced state of the input audio signal or transmitting the second data and subsequently stopping transmission when an unvoiced state of the input audio signal is detected subsequent to a voiced state.

In accordance with the voice encoding system and the encoding method of the present invention, by invalidating or removing a part of the pitch information, natural background noise can be obtained in the voice decoder. More specifically, it is noted in the present invention that the conventional voice encoders used the pitch parameters in the decoded signal regardless of a voiced frame or an unvoiced frame of the input audio signal. This included wrong pitch information in the resultant decoded signal, which generated unnatural background noise in the output of the conventional voice decoders.

The above and other objects, features and advantages of the present invention will be more apparent from the following description, referring to the accompanying drawings.

PREFERRED EMBODIMENT OF THE INVENTION

Figure 1:
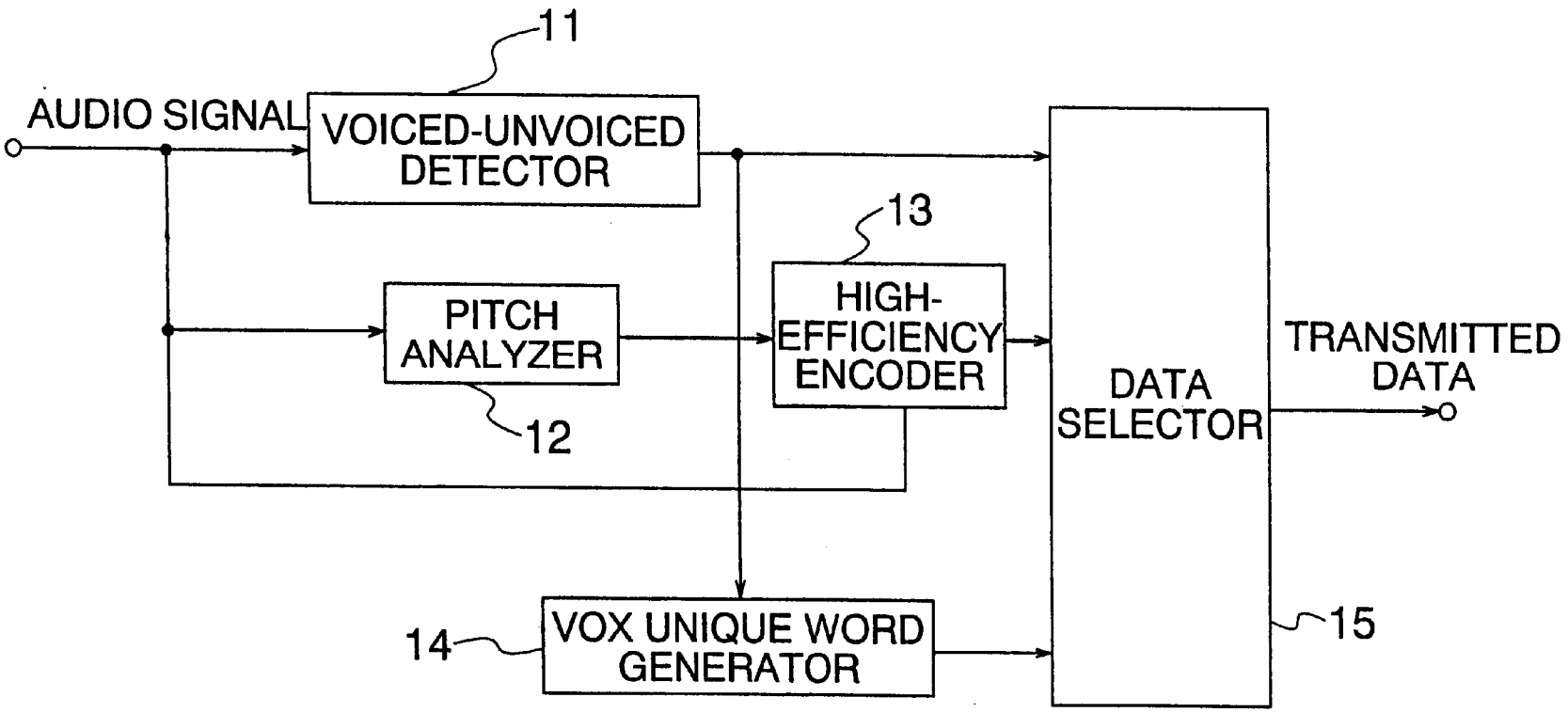
FIG. 1 PRIOR ART
FIG. 1 is a block diagram of a conventional voice encoder.
Figure 2:
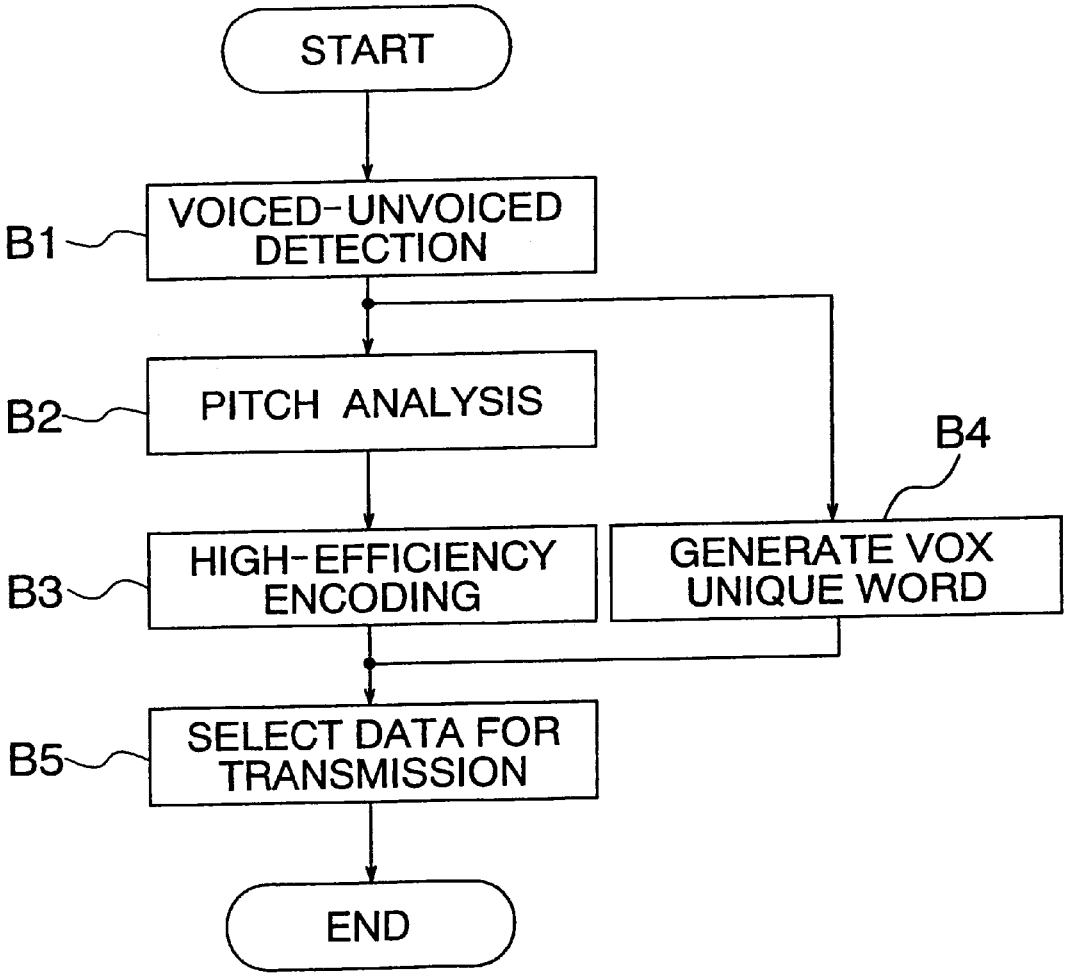
FIG. 2 PRIOR ART
FIG. 2 is a flowchart of the voice encoder shown in FIG. 1.

Now, the present invention is described more specifically based on a preferred embodiment thereof with reference to the accompanying drawings, wherein similar constituent elements are designated by same or similar reference numerals throughout the drawings.

Figure 3:
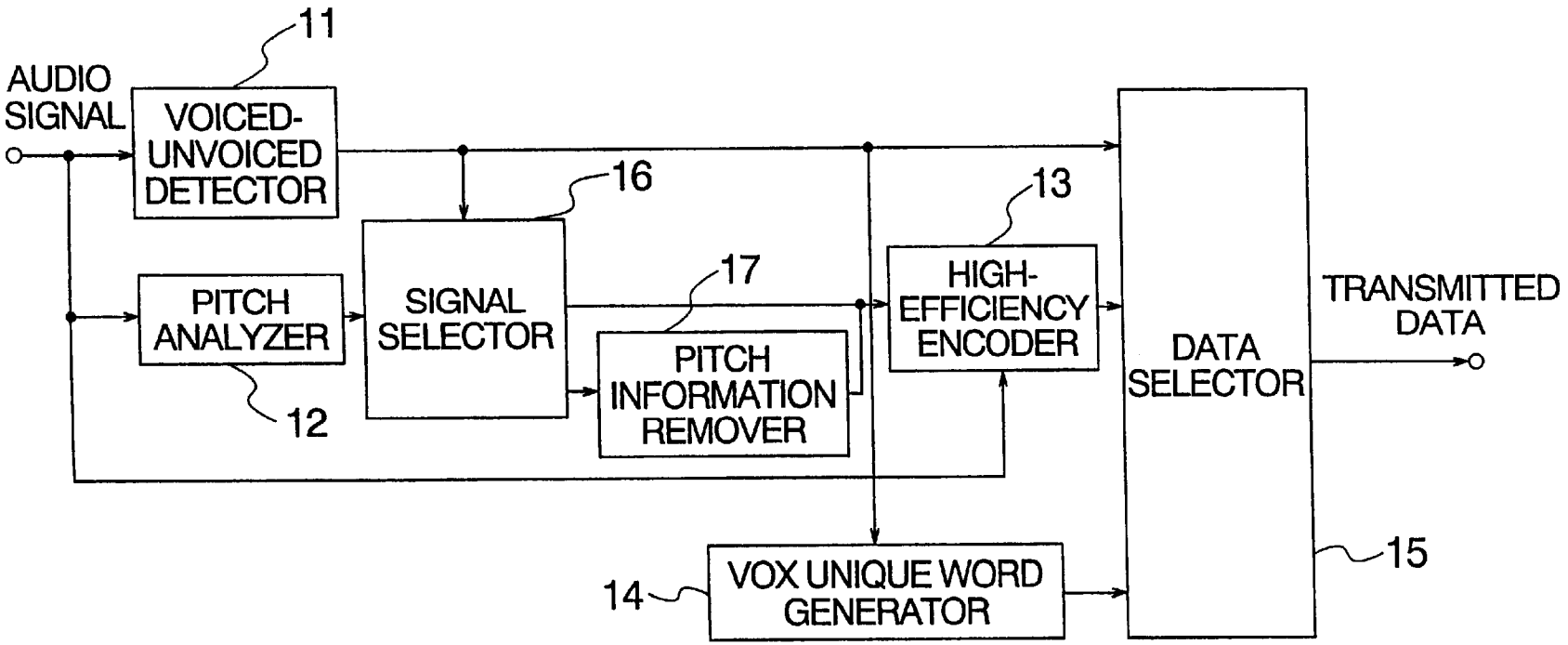
FIG. 3 is a block diagram of a voice encoder according to an embodiment of the present invention.

Referring to FIG. 3, a voice encoder in a transmitting section of a communication system according to an embodiment of the present invention comprises a voiced-unvoiced detector 11, a pitch analyzer 12, a high-efficiency encoder 13, a VOX unique word generator 14, and a data selector 15, which are common to the conventional voice encoder of FIG. 1. The voice encoder further comprises a signal selector 16 and a pitch information remover 17 according to the principle of the present invention.

In the voice encoder of the present embodiment, the pitch analyzer 12 and the high-efficiency encoder 13 extract parameters that features voice in each frame of the input audio signal, similarly to the conventional voice encoder. If it is judged by the voiced-unvoiced detector 11 that the present frame of the input audio signal includes voice, the signal selector 16 transmits the pitch information from the pitch analyzer 12 to the high-efficiency encoder 13, wherein the pitch parameters are encoded. On the other hand, if it is judged that the present frame does not include voice whereas the precedent frame included voice, the signal selector 16 transmits the pitch parameters to the pitch information remover 17, which invalidates a part of the pitch information and delivers the processed parameters to the high-efficiency encoder 13. The high-efficiency encoder 13 then generates a background noise code series from the input audio signal and based on the parameters supplied from the pitch information remover 17.

Examples for the pitch analyzer 12 include a long-term predicting device of a CELP encoding system, which is described in a literature "High-Efficiency Voice Encoding Technology for Digital Mobile Communication" pp. 87–92, by Ozawa, Apr. 6, 1992, Trikepps.

The pitch information includes a delay information (pitch period) and a gain information (pitch coefficient) of the adaptable code book described in the above literature. The term "invalidate a part of the pitch information" as used in this text means to make the gain (pitch coefficient) in the pitch parameters "0" with the pitch period unchanged.

The high-efficiency encoder 13 encodes the input audio signal by using a high-efficiency encoding technique and the invalidated pitch information to generate a background noise updating code series and transmits the same through the data selector 15 as the data for transmission. Subsequently, the voice encoder stops transmission for N frames wherein N is a constant. If the input audio signal does not include voice for more than N frames, the voice encoder again transmits another post-amble signal frame and a background noise updating code series after N frames elapsed from the frame in which the last post-amble signal and background noise updating code series are transmitted. Thereafter, the voice encoder stops transmission for additional N frames. The voiced-unvoiced detector 11 continues detection of the voiced or unvoiced state of the input audio signal for each frame, and the voice encoder restarts transmission of encoded code series of the input audio signal if it is judged that the input audio signal again includes voice.

Figure 4:
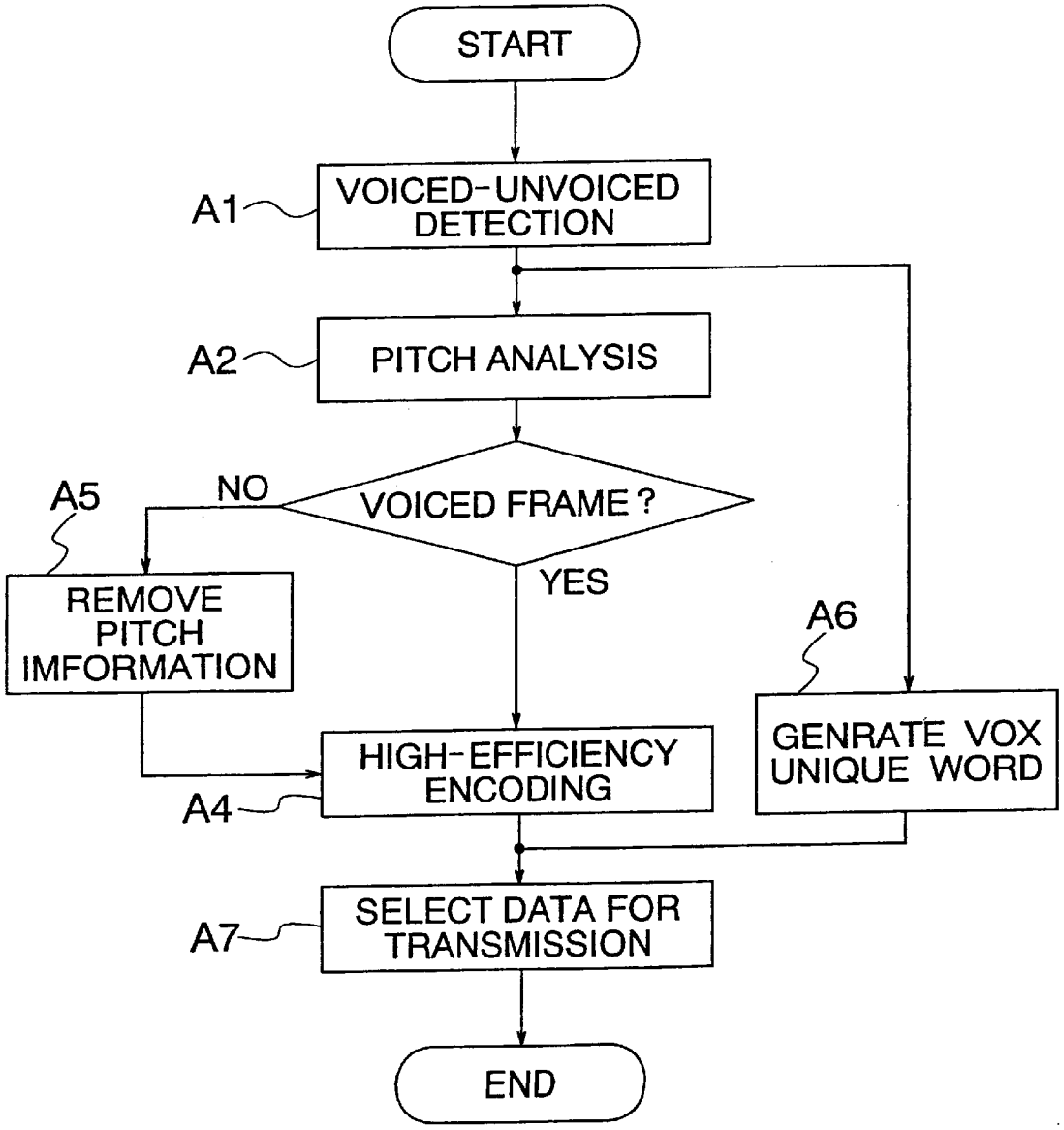
FIG. 4 is a flowchart of the voice encoder shown in FIG. 3.

Now, operation of the voice encoder of the present embodiment will be more specifically described with reference to FIG. 4 showing a flowchart of the voice encoder of FIG. 3.

Before encoding, the input audio signal is divided into a plurality of frames each having a 40 msec. time interval. Each frame of the input audio signal is supplied to the voice-unvoiced detector 11, wherein it is examined whether or not the present frame includes voice (step A1). The input audio signal is also supplied to the pitch analyzer 12, wherein pitch parameters are extracted from the input audio signal in the present frame to generate a pitch information signal based on the extracted pitch parameters (step A2).

If it is judged that the present frame includes voice (step A3), the pitch information signal from the pitch analyzer 12 is supplied together with the input audio signal to the high-efficiency encoder 13, wherein high-efficiency voice encoding and extracting another parameters are performed to generate a high-efficiency code series (step A4). The data selector 15 selects the high-efficiency code series supplied from the high-efficiency encoder 13 to transmit the same to the voice decoder in the receiving section.

On the other hand, if it is judged by the voiced-unvoiced detector 11 that the present frame does not include voice whereas the precedent frame included voice, the VOX unique word generator 14 generates a post-amble signal for the present frame (step A6), which is selected and transmitted to the decoder through the data selector 15 as a code series for transmission (step A7). For the next frame, the pitch analyzer 12 analyzes the pitch of the input audio signal (step A2), the pitch information remover 17 invalidates a part of the pitch information (step A5), the high-efficiency encoder 13 encodes the input audio signal based on the invalidated pitch information (step A4), and the resultant encoded signal is transmitted to the voice decoder (step A7). Subsequently, the voice encoder stops encoding for N frames. If the unvoiced state continues for more than N frames, the voice encoder again generates another post-amble signal and another background noise updating code series after N frames elapsed, and transmits the same to the decoder, followed by stopping of the transmission for additional N frames.

The voiced-unvoiced detector 11 continues for detection of the voiced or unvoiced state of the input audio signal during stopping of the transmission after the voice encoder transmits the post-amble signal and the background noise updating series (step A1). If it is judged that the present frame now includes voice, the VOX unique word generator 14 generates a pre-amble signal frame (step A6), which is transmitted through the data selector 15 to the voice decoder (step A7). After the transmission of the pre-amble signal frame, the voice encoder continues for transmission of high-efficiency code series generated by the high-efficiency encoder 13 through the data selector 15 to the receiving section so long as the voiced state continues for the subsequent frames.

In the present embodiment, if the input audio signal does not include voice, a part of the pitch information is made invalid by the pitch information remover 17, whereby the voice decoder can generate natural background noise based on the post-amble signal wherein the pitch information is made invalid.

Since the above embodiments are described only for examples, the present invention is not limited to the above embodiments and various modifications or alterations can be easily made therefrom by those skilled in the art without departing from the scope of the present invention.

What is claimed is:

1. A voice encoder comprising:

a voiced-unvoiced detector for judging whether or not an input audio signal includes voice in each frame of the input audio signal to output a voiced-unvoiced signal, a pitch analyzer for extracting pitch information from the input audio signal, a signal selector for receiving said voiced-unvoiced signal and said pitch information and, in response to said voiced-unvoiced signal, selectively outputting either a first signal including the input audio signal and the pitch information or a second signal including the input audio signal with at least a part of the pitch information being invalidated depending on said voiced-unvoiced signal, a high-efficiency encoder for encoding the first signal or the second signal to generate first data or second data, and a data selector for selectively transmitting either said first data during a voiced state of the input audio signal, or said second data and subsequently stopping transmission when an unvoiced state of the input audio signal is detected subsequent to a voiced state.

2. A voice encoder as defined in claim 1 further comprising a VOX unique word generator for generating a post-amble signal, wherein said data selector selects said post-amble signal prior to transmitting said second data.

3. A voice encoder as defined in claim 1, wherein said part of the pitch information includes gain information.

4. A method for encoding an input audio signal comprising the steps of:

judging a voiced or unvoiced state of an input audio signal in each frame of the input audio signal, extracting pitch information from the input audio signal, generating either first data encoded from the input audio signal and pitch information of the input audio signal, or second data encoded from the input audio signal with the pitch information at least partly invalidated, depending on the voiced or unvoiced state of the input audio signal, and transmitting said first data during a voiced state of the input audio signal or transmitting said second data and subsequently stopping transmission when an unvoiced state of the input audio signal is detected subsequent to a voiced state.

5. A method as defined in claim 4, further comprising the step of transmitting a post-amble signal prior to transmitting said second data.

6. A method as defined in claim 4, wherein said part of pitch information includes gain information.

* * * * *